US006981559B2

(12) United States Patent
Rubie et al.

(10) Patent No.: US 6,981,559 B2
(45) Date of Patent: Jan. 3, 2006

(54) ROCK-BOLTING APPARATUS AND METHOD

(75) Inventors: Peter John Rubie, Toowoomba (AU); Alan John Russell, Toowoomba (AU)

(73) Assignee: RME Underground Pty Ltd., Toowoomba (AU)

( * ) Notice: Subject to any disclaimer, the term of this patent is extended or adjusted under 35 U.S.C. 154(b) by 0 days.

(21) Appl. No.: 10/733,081

(22) Filed: Dec. 11, 2003

(65) Prior Publication Data

US 2004/0177979 A1 Sep. 16, 2004

Related U.S. Application Data

(63) Continuation-in-part of application No. PCT/AU02/00791, filed on Jun. 18, 2002.

(30) Foreign Application Priority Data

Jun. 18, 2001 (AU) ..... PR5765

(51) Int. Cl.
*E21B 7/04* (2006.01)

(52) U.S. Cl. ..... 173/184; 173/25; 173/28

(58) Field of Classification Search ..... 173/25, 173/28, 34, 38, 184, 192, 4, 11; 408/111, 408/129; 299/33, 31, 64, 11, 7; 405/297, 405/299; 414/4, 5

See application file for complete search history.

(56) References Cited

U.S. PATENT DOCUMENTS

| | | | | |
|---|---|---|---|---|
| 4,196,935 A | | 4/1980 | Dring | |
| 4,251,168 A | | 2/1981 | Groetschel | |
| 4,344,599 A | * | 8/1982 | Herron | 248/660 |
| 4,364,540 A | * | 12/1982 | Montabert | 248/654 |
| 4,410,049 A | * | 10/1983 | Molin | 173/2 |
| 4,832,536 A | * | 5/1989 | Spross et al. | 405/303 |
| 5,114,279 A | * | 5/1992 | Bjerngren et al. | 405/303 |
| 5,544,746 A | | 8/1996 | Dohi | |
| 5,720,582 A | * | 2/1998 | Morrison et al. | 405/303 |
| 5,752,789 A | * | 5/1998 | Stepan | 408/17 |
| 5,816,750 A | | 10/1998 | Steffenino | |
| 6,036,013 A | | 3/2000 | Chen | |

FOREIGN PATENT DOCUMENTS

| | | |
|---|---|---|
| AU | 199935788 | 1/2000 |
| AU | 200061277 | 3/2001 |
| DE | 29920176 | 2/2000 |
| EP | 0379187 | 7/1990 |
| SU | 1469149 | 3/1989 |
| WO | 0060211 | 10/2000 |

* cited by examiner

*Primary Examiner*—Louis K. Huynh
*Assistant Examiner*—Chukwurah Nathaniel
(74) *Attorney, Agent, or Firm*—Hedman & Costigan, P.C.

(57) ABSTRACT

An articulated boom arm for a rock boring machine, comprising a first kinked member having a drill guide at one end and a base pivot at the other end, and a pair of pivoted links. One of said links having a first end pivoted at said base pivot, the other of the links having a drill pivotally mounted at a first end thereof. The second ends of The first and second links being pivoted to each other whereby said drill is reciprocally linearly movable along said first member with a drill bit aligned with said drill guide and at one extremity of the reciprocal movement both said pair of links are substantially longitudinally aligned and extend towards said drill guide, and at the other extremity of the reciprocal movement both said pair of links are substantially longitudinally aligned and extend away from said drill guide.

4 Claims, 13 Drawing Sheets

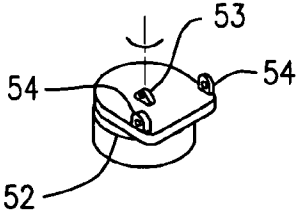
FIG. 6A
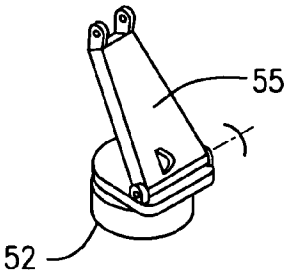
FIG. 6B
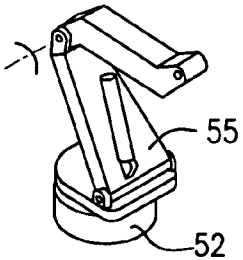
FIG. 6C
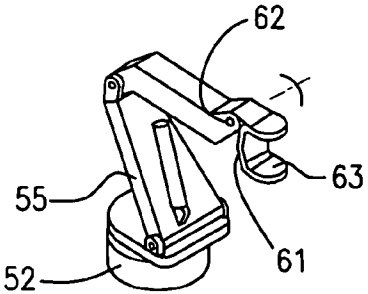
FIG. 6D
FIG. 6E
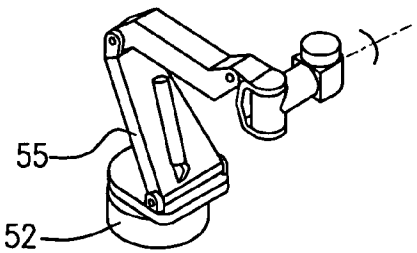
FIG. 6F
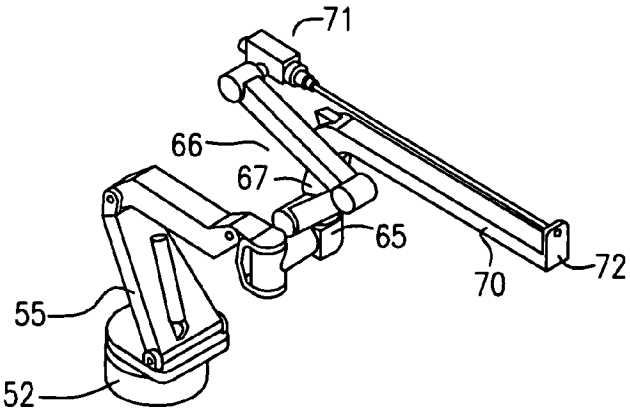
FIG. 6G

ROCK-BOLTING APPARATUS AND METHOD

REFERENCE TO RELATED APPLICATIONS

The present application is a continuation-in-part of International PCT Application No. PCT/AU02/00791 filed on Jun. 18, 2002, which claims priority on Australian Provisional Application No. PR 5765 filed on Jun. 18, 2001.

TECHNICAL FIELD

This invention relates to a rock-bolting apparatus and method.

This invention has particular but not exclusive application to a rock-bolting apparatus and method for use in mine construction, and for illustrative purposes reference will be made to such application. However, it is to be understood that this invention could be used in other applications, such as general tunnel construction, underpinning and the like.

BACKGROUND

Underground mining of mineral ores, such as coal and hard and soft rock mining requires the 'development' of underground drives in the form of tunnels. In all hard-rock applications, drive development is achieved through a drilling, charging, blasting, and mucking cycle. In the drilling stage of the cycle, a pattern of holes is drilled into the blind end of the drive. The holes are generally parallel to the drive axis. Typically, holes are 2–4 meters deep.

In the charging stage, explosive is placed in the drilled holes and connected via a detonating arrangement. In the blasting stage the explosive is detonated, the resulting blast fracturing the solid rock. In the mucking stage a front-end loader digs the fractured rock and removes it for hoisting to the surface via skips. This development cycle is well understood and is currently the most cost effective means of developing drives in hard rock.

An unavoidable consequence of this proven method is rock fracture beyond the desired geometric shape of the tunnel cross-section. This rock fracturing can cause the tunnel roof or back and/or the drive's side-walls to be unstable. Rock fragments large and small can disengage from the back and sidewalls and fall under the influence of gravity. Particle size ranges from microscopic to cubic meters. Falling particles larger than a tennis ball can prove fatal to personnel.

To protect miners from larger falling particles, a rock bolting/meshing procedure is applied. The process requires drilling holes 2–4 meters long in the 'back' (walls and overhead), and holding square mesh, typically 50 mm×50 mm to 150 mm×150 mm apertures, against the 'back'. Rock bolts and retaining plates are inserted through the mesh and into the drilled holes. Larger particles are restrained from falling by the rock-bolts and smaller particles are retained or caught by the mesh.

Rock bolts come in various styles and each style is available in a range of lengths. Common styles include the split set type where long slotted tubes grip the drilled hole via radial springing action along the entire length of the bolt. These bolts rust away in time and jeopardize long-term security. The wedge-lock type is a bolt with an expanding tip, the locking action being controlled by screwing action. The gripping is at the blind end of the hole only. These bolts also rust away in time and jeopardize long-term security. Epoxy grouted systems utilize a two-pack epoxy sausage which is inserted into the drilled hole. The bolt is inserted via a rotating action that mixes the epoxy. Curing is rapid usually taking about 35–60 seconds. In such epoxy grouted systems gripping occurs substantially along the entire length of the bolt/hole. These epoxy grout system bolts resist corrosion. Cement grouted systems are also used.

Rock-bolting/meshing equipment comes in two broad groups, comprising purpose built drilling bolting machines and adaptations of twin boom development heading 'jumbo' drills. The purpose built drilling bolting machines generally feature three parts, being a transport vehicle subassembly, a multi-axis support arm mounted thereon and a drilling and bolting mechanism on the support arm. The drilling and bolting mechanism contains many functions and is relatively heavy, both for robustness and to provide inertial stability. The multi-axis support arm, while capable of supporting the mechanism, tends to deflect, has low natural frequencies of bobbing up/down and back/forth and also has poor 'fine control'. The transport vehicle is rubber tyred, with articulated steering, diesel powered and with front jacks for vehicle stability while working.

In use, problems arise because of the physical properties of the freshly fractured rock surface. It is uneven and fractured, presenting a myriad of randomly oriented faces. Lighting from the vehicle throws this surface into stark black/white features where the operator cannot determine the inclination of faces to select a stable face for drilling.

Collaring is the step of the drill taking purchase and commencing the new hole and usually describes the first 0–20 mm of drilling. The drill head is a blunt steel arrangement with embedded tungsten carbide tips, air or water cooled and purged via a central hole along the drill steel. Cutting is by rotation and impact from the drill, with typical drilling speeds being at 1–2 meters per minute. When the blunt drill head strikes an angled rock face in attempting to collar a new hole, it generally cannot achieve penetration. Instead the drill slides down the face until it finds purchase in the 'valley' between two intersecting planes of the rock faces. Collaring now proceeds as does the remainder of the hole drilling.

The drill bit, sliding down the rock face and into the 'valley' demands lateral compliance since the support arm's hydraulics have not yielded or adjusted. Compliance is available from many sources including elastic bending of the drill steel, mechanical play or hackles in the drill steel/drill interface, the drill/drill slide interface and every other mechanical junction, deflection in the supporting arm, and deflection in the supporting vehicle.

The drill achieves a collared and drilled hole, albeit not precisely where the drill was aimed. Upon drill steel extraction form the new hole, the elastic compliance is released and the whole machine wobbles back and forth, finally settling with the drill steel axis no longer aligned with the freshly drilled hole. The mechanism now increments, removing the drill from the axis and replacing it with a bolt magazine with an inserted bolt. The bolt has little chance of finding the hole because the mechanical 'slop' (play, clearance, backlash) is endemic, with machine parts which are expected to operate reliably despite spending their lives in a shower of water, grit and falling rocks. The net effect is that the drilled hole will often not be co-axial with the bolt. Rock fragments often fall from the 'back' around the freshly drilled hole to sit on the mesh, masking the hole. Attempting to insert an all metal bolt is normally unsuccessful.

The machine operator then gets out of his protected cabin and walks under the unprotected cabin and walks under the unprotected, freshly fractured, freshly drilled ground to try and find the offset error between where the hole axis lies and where the bolt axis lies. This is the most dangerous time with a high risk of falling rock causing death or injury. The operator then goes back to his machine and tries to remember the direction and distance of the offset and, using an arm with poor 'fine control', attempts to adjust for the error. There are often several attempts required to adjust for bolt insertion. With epoxy-grouted bolts, these aiming problems can see the two-part epoxy sausage bursting, covering the drilled/bolting mechanism and/or the hole opening with rapidly setting epoxy, which can disable the mechanism and/or block the hole.

SUMMARY OF INVENTION

According to a first aspect the present invention consists in an articulated boom arm for a rock boring machine, said arm comprising a first kinked member having a drill guide at one end and a base pivot at the other, and a pair of pivoted links, one of said links having a first end pivoted at said base pivot, the other of said links having a drill pivotally mounted at a first end thereof, the second ends of said first and second links being pivoted to each other whereby said drill is reciprocally linearly movable along said first member with a drill bit aligned with said drill guide and at one extremity of the reciprocal movement both said pair of links are substantially longitudinally aligned and extend towards said drill guide and at the other extremity of the reciprocal movement both said pair of links are substantially longitudinally aligned and extend away from said drill guide.

Preferably said arm is mounted on a seven axis manipulator assembly, said assembly comprising a turntable rotatable about a first substantially vertical axis, a first arm pivotally mounted to said turntable about a second, substantially horizontal axis, a second arm pivotally about a third, substantially horizontal axis, a yoke pivotally mounted to said second arm about a fourth, substantially horizontal axis and having a pair of arms defining a fifth axis about which a trunnion is pivoted, and a boom arm base support pivoted to said trunnion about a sixth axis substantially perpendicular to said fifth axis, said boom arm fist member being rotatably mounted to said base support about a seventh axis substantially perpendicular to said sixth axis.

Alternatively, a six axis manipulator can be provided.

Preferably said pair of links can be manipulated between said extremities to provide multiple modes of operation, to provide a longer stroke for blast hole drilling and a shorter stroke for drilling and bolting.

According to a second aspect the present invention consists in magazine system for elongate rock bolts having a shaft with a front tip at one end and a drive means at the other end, said system comprising a plurality of said bolts arranged in a substantially parallel array, at least one belt extending substantially transversely to said bolts and having a plurality of spaced receptors each of which accommodates a corresponding bolt; and a housing for said magazine having a length exceeding the length of said bolts.

In one embodiment said belt is arranged in serpentine fashion within said housing to permit said bolts to be sequentially removed from said housing but retained in said parallel array.

In another embodiment said belt is arranged in a radial fashion within said housing to permit said bolts to be sequentially removed from said housing.

Preferably said receptors are substantially equally spaced apart.

Preferably where two of said belts are provided, said belts being longitudinally spaced apart relative to said bolt shafts.

Preferably said at least one belt is disintergratable.

Preferably washer plates adapted for use with said bolts are stored in stacked relationship in a separate magazine housing away from said bolts.

According to a third aspect the present invention consists in a dispensing device for steel reinforcing mesh, said device comprising a roll of said mesh mounted to permit unrolling movement of said mesh about the longitudinal axis of said roll, the free end of said roll passing between straightening rollers arranged to increase the radius of curvature of said mesh on passing therethrough, and mesh severing means located downstream of said rollers to cut the at least partially straightened mesh to length.

Preferably said device is mounted on a wheeled carriage.

According to a fourth aspect the present invention consists in a method of applying steel reinforcing mesh to a tunnel or drive, said method comprising the steps of:

(i) unwinding a length of mesh from a roll thereof;

(ii) at least partially straightening said length of mesh to increase the radius of curvature thereof;

(iii) cutting said at least partially straightened mesh to suit the peripheral dimensions of said tunnel or drive;

(iv) securing said cut length of mesh to said tunnel or drive periphery with rock bolts or equivalent securing devices; and (v) repeating steps (i)–(iii) above and then securing the newly cut length of mesh adjacent the previously secured length of mesh.

Preferably said tunnel or drive has a floor and a substantially arch shaped roof and side walls and said mesh is applied to said roof and side walls only.

BRIEF DESCRIPTION OF THE DRAWINGS

The invention will be further described with reference to the drawings illustrating a preferred embodiment of the present invention and wherein:

FIGS. 6A–G is a partial perspective view of the apparatus of FIG. 1, showing sequential assembly of the slewing primary arm assembly;

MODE OF CARRYING OUT INVENTION

Figure 1:
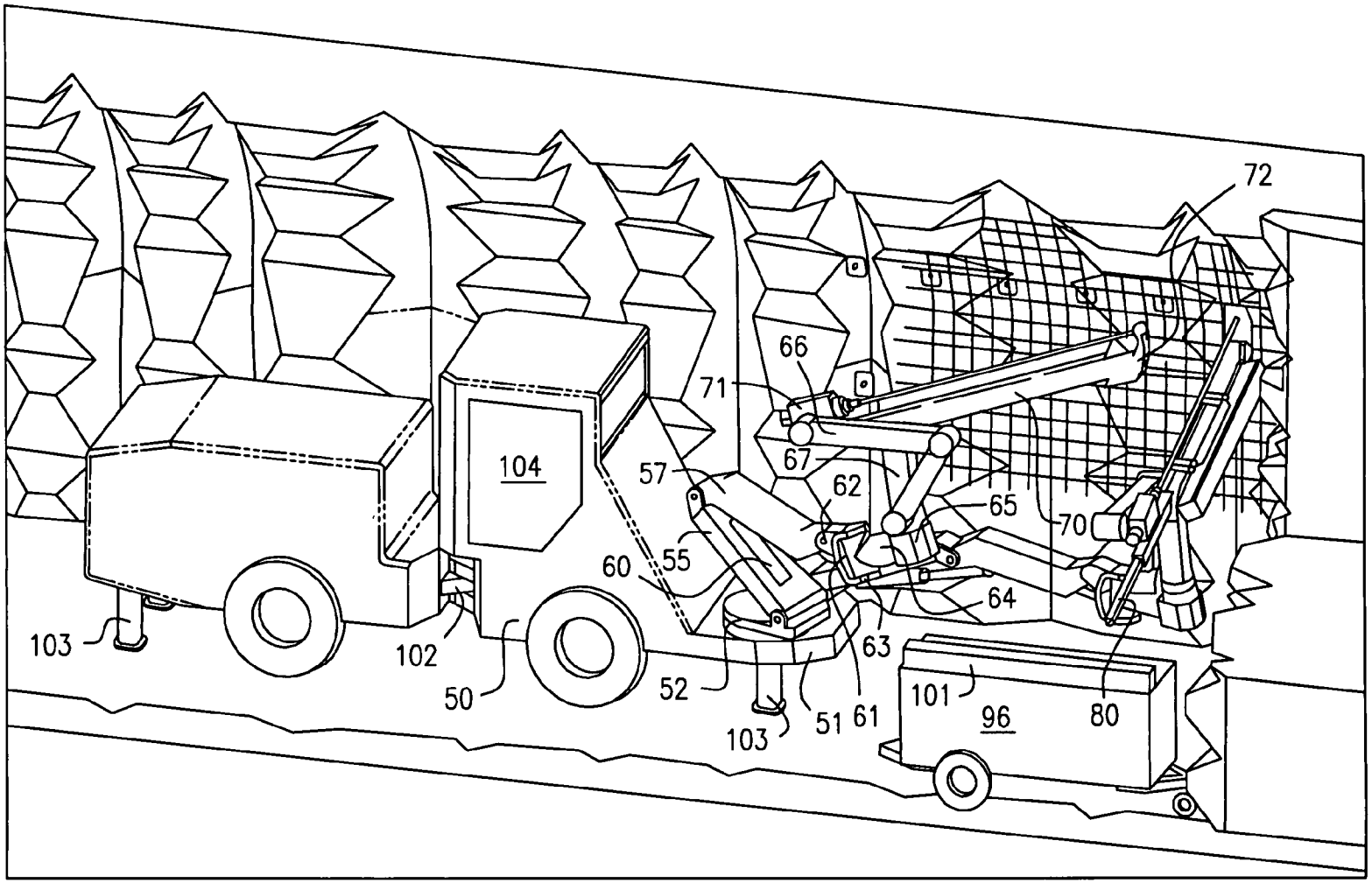
FIG. 1 is a perspective view of an embodiment of apparatus in accordance with the present invention, in use.
Figure 2:
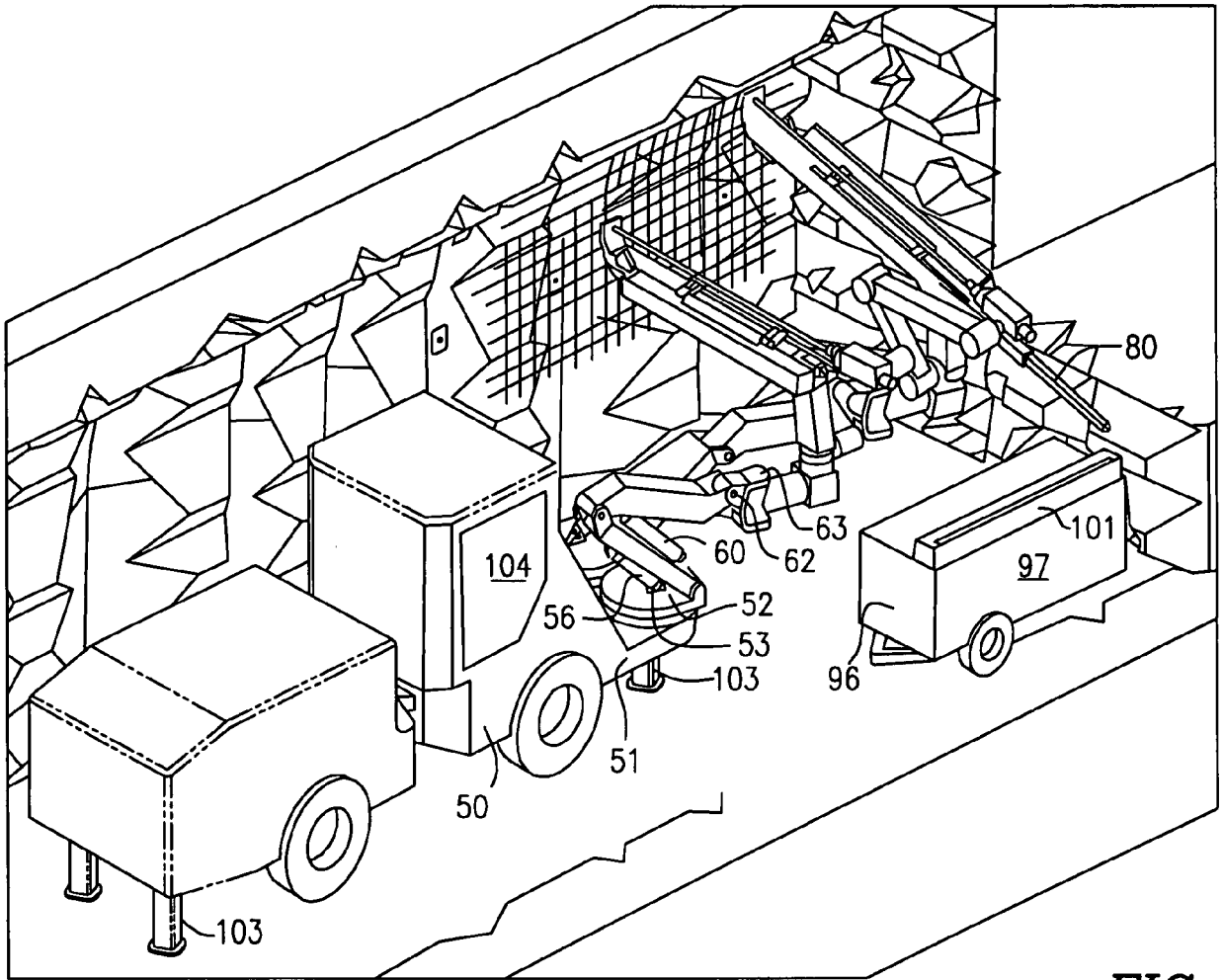
FIG. 2 is a further perspective view of the apparatus of FIG. 1, in use.

In the embodiment illustrated in FIGS. 1 to 15, there is shown a rock bolting apparatus in accordance with the present invention having a twin-boom jumbo chassis forming carriage 50. Machinery platform 51 of carriage 50 mounts a pair of slewing bases 52. The slewing bases 52 each have a pair of spaced hard points 54 for pivotally mounting a primary arm lower member 55, the relative disposition of which is provided by a ram 56 disposed between lower member 55 and a third hard point 53 on slewing base 52. A primary arm upper member 57 is hinged to lower member 55, and the relative disposition of the upper member 57 and lower 55 members is controlled by a ram 60 disposed between the upper and lower arms.

The upper and lower arms operate in a vertical plane that can be slewed via the slewing base. A yoke 61 is pivoted to the outer end of the upper member 57 via a yoke pivot 62 having an axis substantially parallel to the articulation between the upper and lower members. The yoke 61 includes a trunnion portion 63 having a trunnion axis substantially perpendicular to the yoke pivot 62.

Articulated in the trunnion portion 63 is a tool mounting base assembly 64 including a tool mounting base 65 having a first mode of rotation in a plane parallel to the trunnion axis and a second mode of rotation in a plane perpendicular to the trunnion axis.

A tool assembly 66, in the form of a kinked member, is supported on the tool mounting base 65 and comprises a common base portion 67 extending integrally into a boom body 70 and further mounting a power head assembly 71.

The boom body 70 has a forward end mounting a drive wall engagement portion 72 having an aperture (drill guide) 73 therethrough of dimension adequate to pass drills and bolts. The wall engagement portion 72 includes a pair of spaced wall engaging ridges 74 disposed about the aperture 73 and defining therebetween a channel 75. The channel 75 is in index with a washer plate magazine 76 disposed below the wall engagement portion 72 and is operable whereby a washer plate 77 may be displaced from the magazine 76 into the channel 75 and into register with the aperture 73.

The boom body 70 further comprises a housing for a telescopic rear strut 80 which is adapted to be deployed to engage the drive wall opposite to the wall engagement portion 72 and thereby brace it into engagement with the drive wall during the drilling and bolting operations.

The boom body 70 has mounted thereon a tool and bolt handling assembly 81 comprising a pair of shaft mounted gripper arms 82 adapted to selectively engage either of a short 84 drill bit a rock bolt 85 or a conventional epoxy or grout tube (not shown). The rock bolts 85 are presented to the gripper arms by bolt magazine housing 86 removably supported on the boom body 70 and having mounted therein a belt 87 comprising plurality of bolts 85 held together by links 90 in a substantially parallel array, whereby the bolts 85 may be sequentially disintegrated from the belt 87 by the gripper arms 82. Belt 87 has plurality of spaced apart receptors each of which accommodates a corresponding rock bolt 85, and is arranged in serpentine fashion within magazine housing 86. The belt 87 is preferably a rubber link belt or webbing belt or other pliant material, such as interconnected rigid links.

The power head assembly 71 comprises a drifter (percussion drill) 91 pivotally mounted on a two-link tool arm 92 pivoted to the common base portion 67 whereby the drifter 91 may be selectively deployed along a line parallel with the boom body 70 (and drive wall engagement portion 72) and having its longitudinal axis aligned with the aperture (drill guide) 73. The two-link tool arm 92 has an intermediate elbow 93 that may be deployed forward of the common base portion 67 to commence a short throw of the drifter 91 for drilling and bolting, and behind the common base portion 67 to commence a long throw for drilling blast holes in the advancing drive face 94, as illustrated in the respective sequences of FIGS. 7 and 8. A view of the drive face drilling operation is also provided in FIG. 9. Any means may be used to rotate the two link tool arm 92, including but not limited to a motor, manual gear, hydraulic actuator or the like.

An advantage of the present embodiment is that the washer plates 77 are stored separately in magazine 76 away from belt 87 of rock bolts 85. In the prior art the rock bolts are housed in magazines with washers attached and therefore take up considerable space.

The drill bit 84 shown in FIG. 7, used for the short throw of drilling and bolting may in one embodiment be about 3 m long, whilst the drill bit 83 shown in FIG. 8 used for a long throw for drilling blast holes may be about 5 m long.

The drifter 91 is fitted with an automatic chuck 95 adapted to receive in turn either of the drill bits 83, 84 or the rock bolts 85.

Figure 10A:
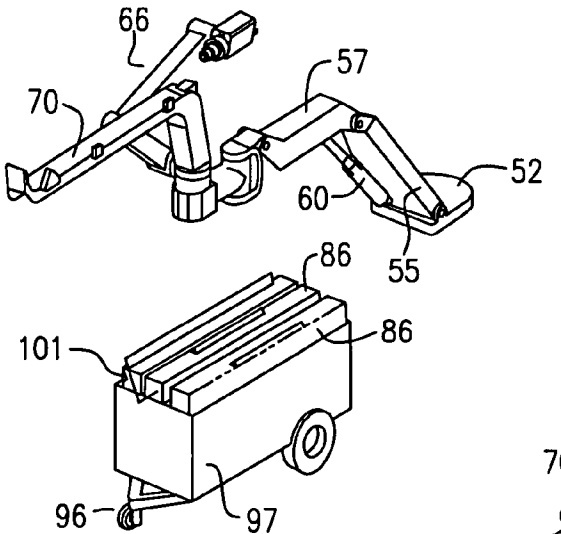
FIGS. 10A–C is a partial perspective view of the apparatus of FIG. 1, showing sequential deployment of bolt magazines.
Figure 10B:
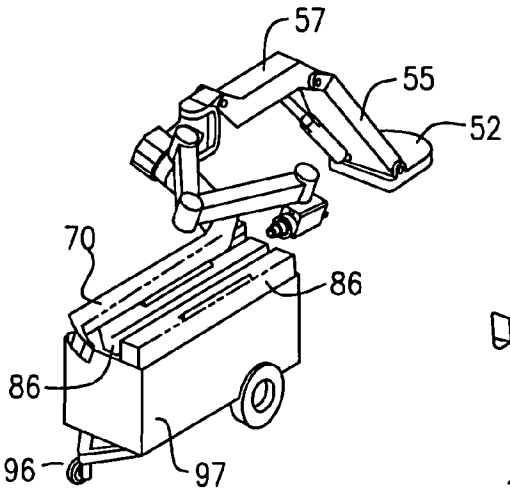
Figure 10C:
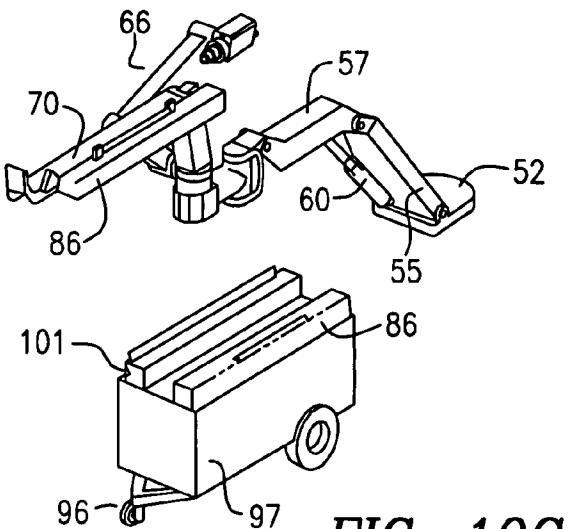
Figure 13:
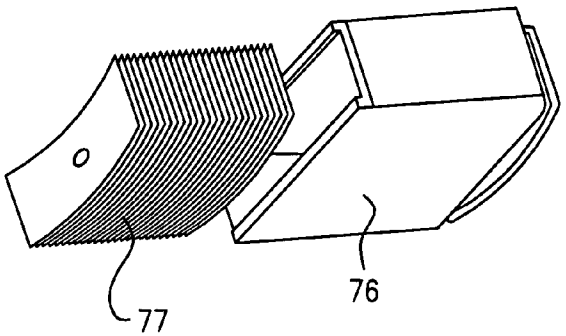
FIG. 13 is a view of the washer plate and magazine assembly for use in the apparatus of FIG. 1.
Figure 11:
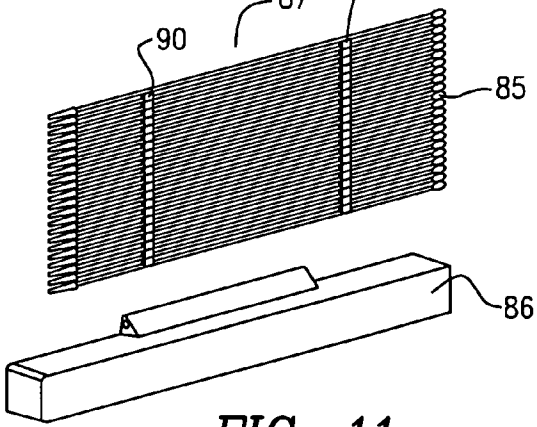
FIG. 11 is a perspective view of linked bolts and magazine for use in the apparatus of FIG. 1.
Figure 12:
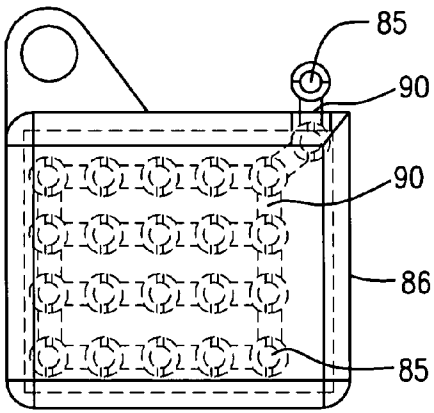
FIG. 12 is an end detail view illustrating the packed configuration of the bolts and magazine of FIG. 11.
Figures 14A, 14B, 14C, 14D, 14E:
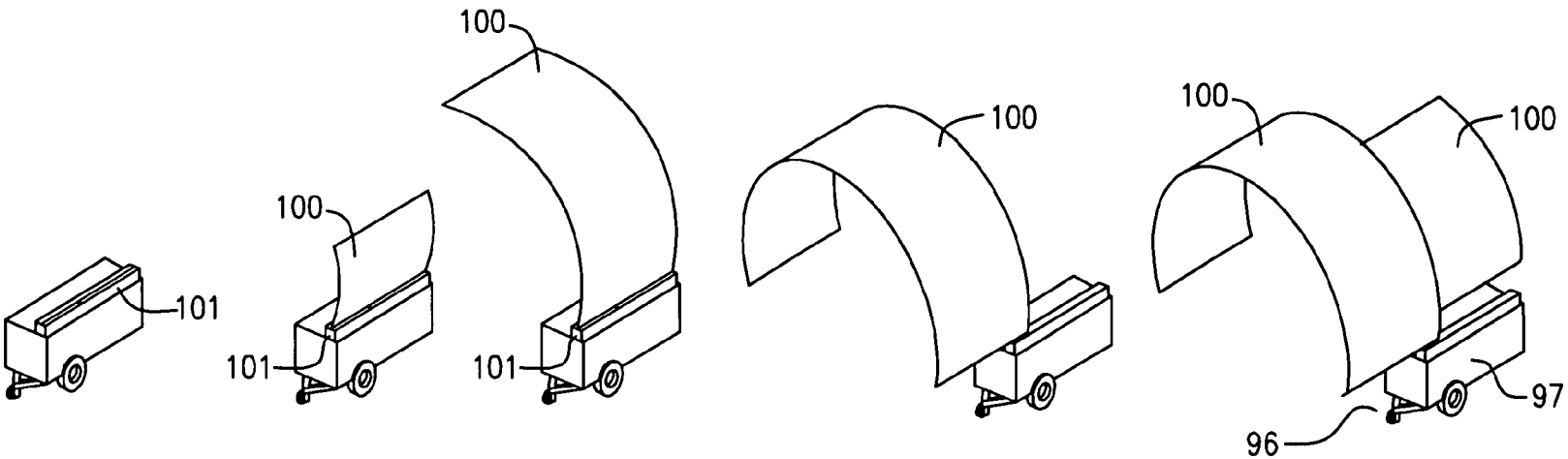
FIGS. 14A–E are sequential illustrations of operation of a mesh magazine suitable for use in the apparatus of FIG. 1.
Figure 15B:
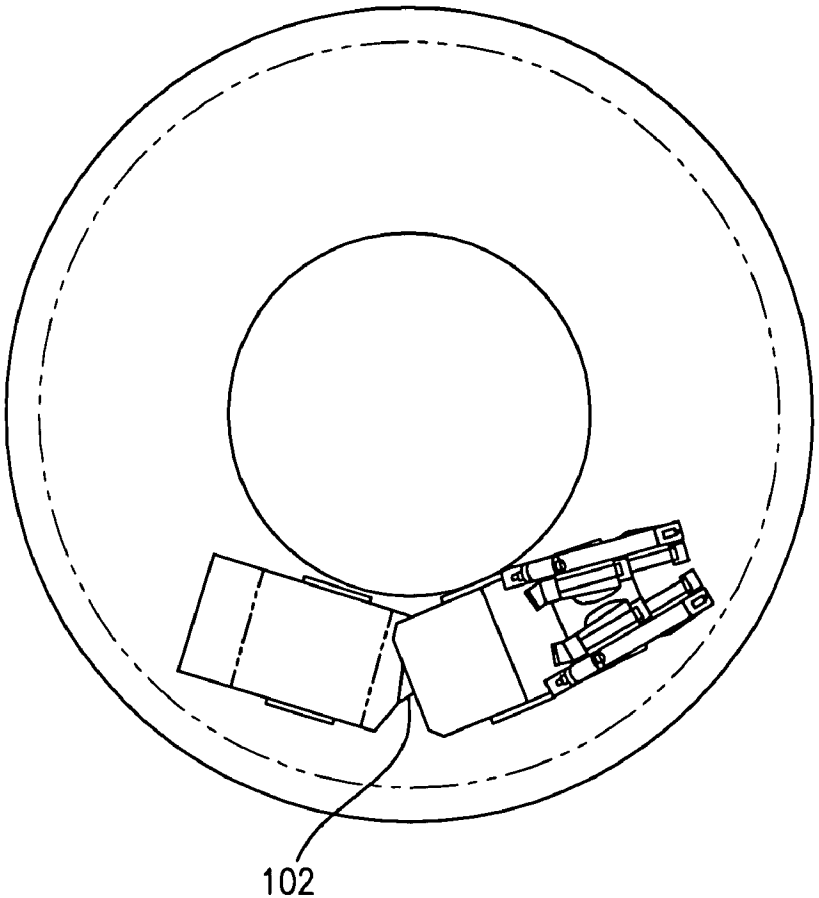
FIGS. 15A–B are perspective and plan view illustrations of the dynamic properties of the apparatus of FIG. 1 in its stowed configuration.
Figure 15A:
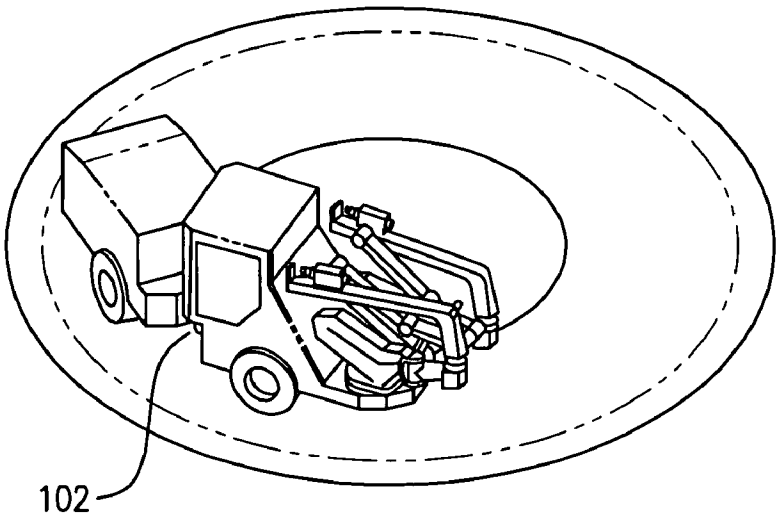

A consumables cart 96 comprises a wheel mounted mesh magazine 97 containing a mesh roll 100 that is led out through a feed and cutter assembly 101. The boom body 70 is adapted to engage the leading edge of the mesh roll 100 for deployment of the mesh in use. The consumables cart 96 has spare bolt magazines 86 which are collectable by the boom arm 70, as illustrated in the sequence of FIGS. 10A to 10C. The carriage 50 is articulated at 102 in order to optimize the turning circle and maneuverability of the carriage 50, as illustrated in FIGS. 15A and 15B. The carriage 50 includes locating jacks 103 adapted to remove the effect of wheel and suspension compliance on stability when drilling and bolting.

For travel, the stewing bases 52 are aligned with the primary arm lower member 55 and upper member 57 fully retracted in a fore-and-aft vertical plane. The telescopic rear strut 80 is fully retracted into the boom body 70 and the boom body 70 is rotated about the tool mounting base 65 to extend back in the direction of the carriage cab 104.

Figure 3A:
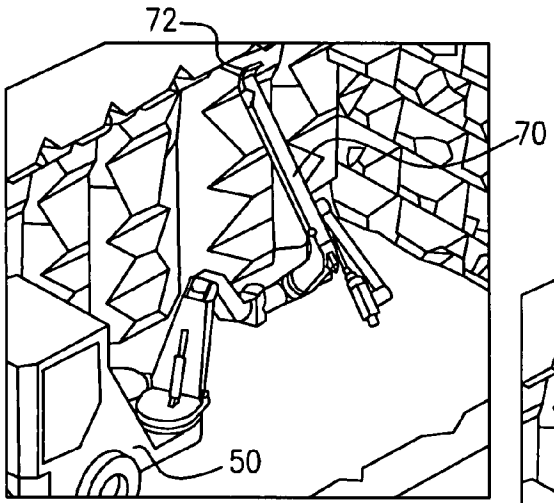
FIGS. 3A–C is a partial perspective view of the apparatus of FIG. 1, showing sequential deployment of the drilling assembly.
Figure 3B:
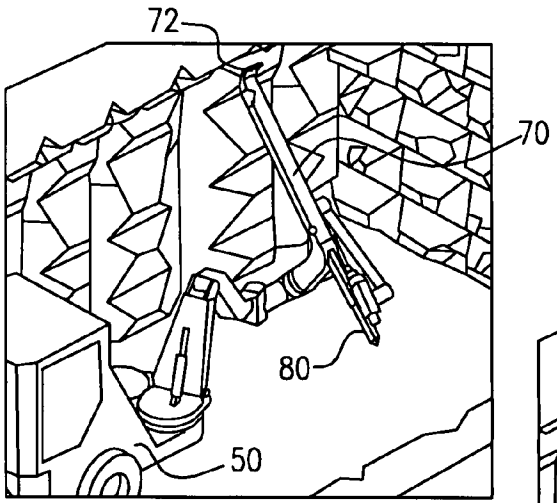
Figure 3C:
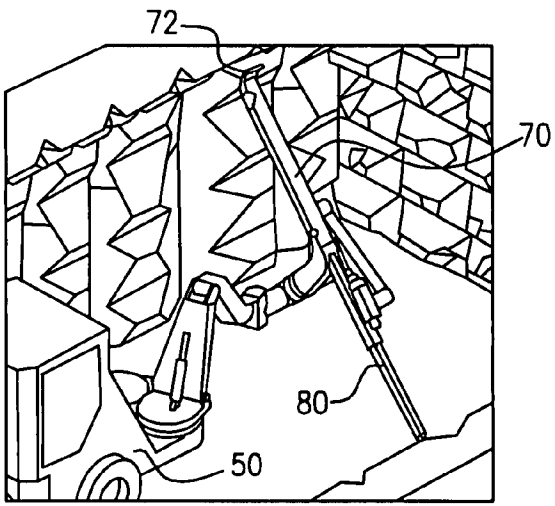
Figure 4:
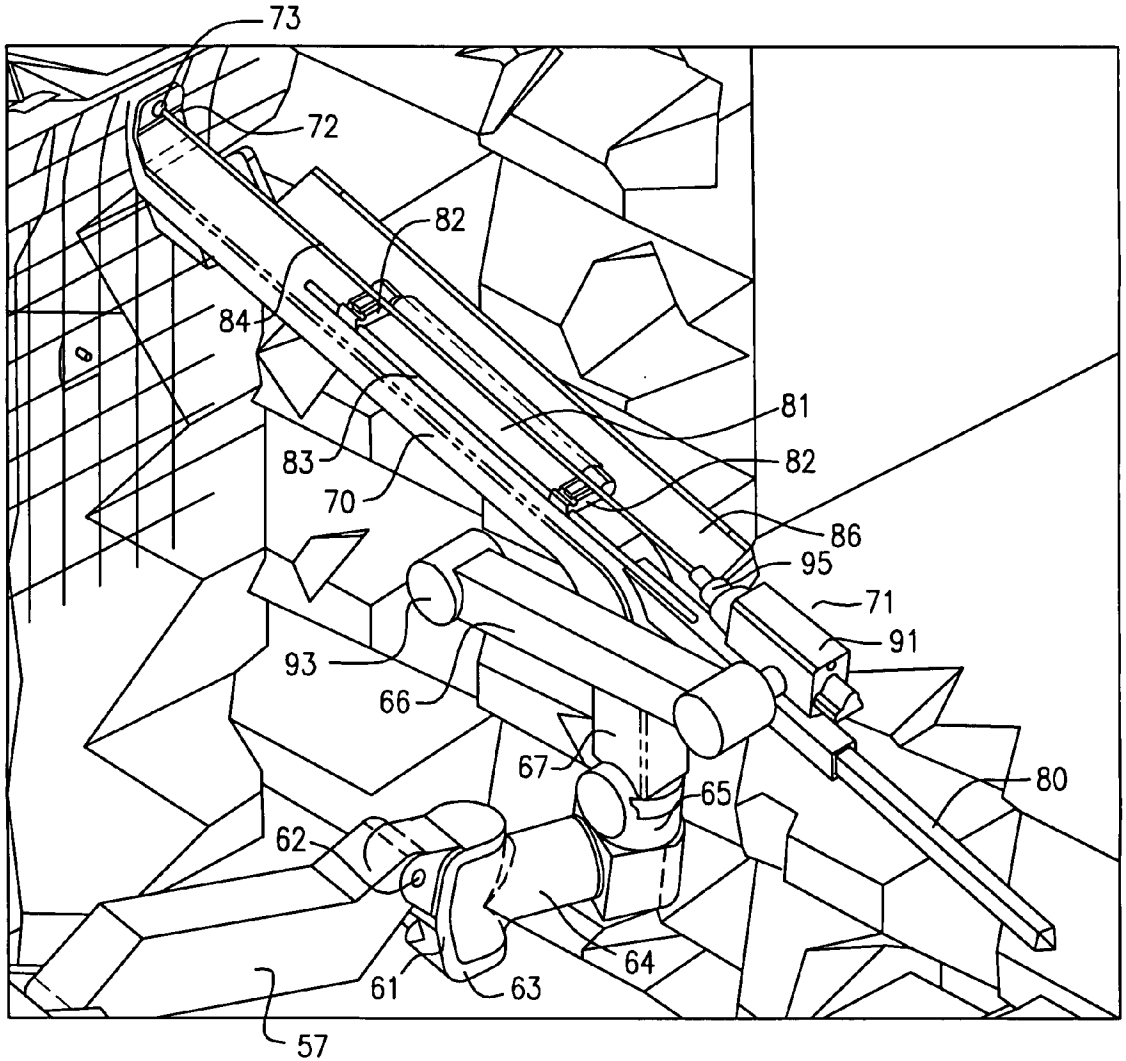
FIG. 4 is a partial perspective view of the apparatus of FIG. 1, showing deployment of the drilling assembly.
Figure 5:
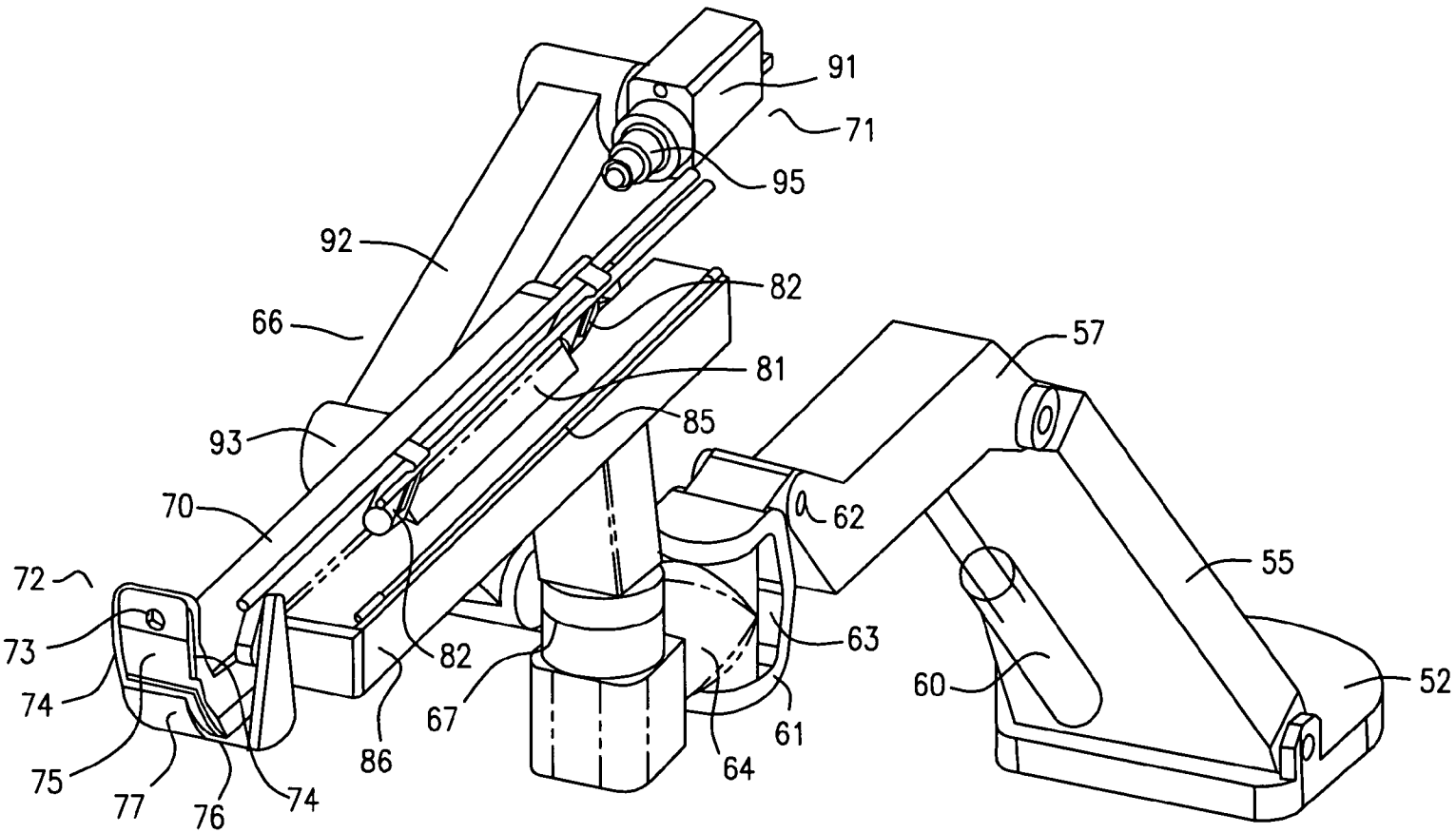
FIG. 5 is a partial perspective view of the apparatus of FIG. 1, showing deployment of the bolting magazine assembly.
Figures 7A, 7B, 7C, 8A, 8B, 8C, 8D:
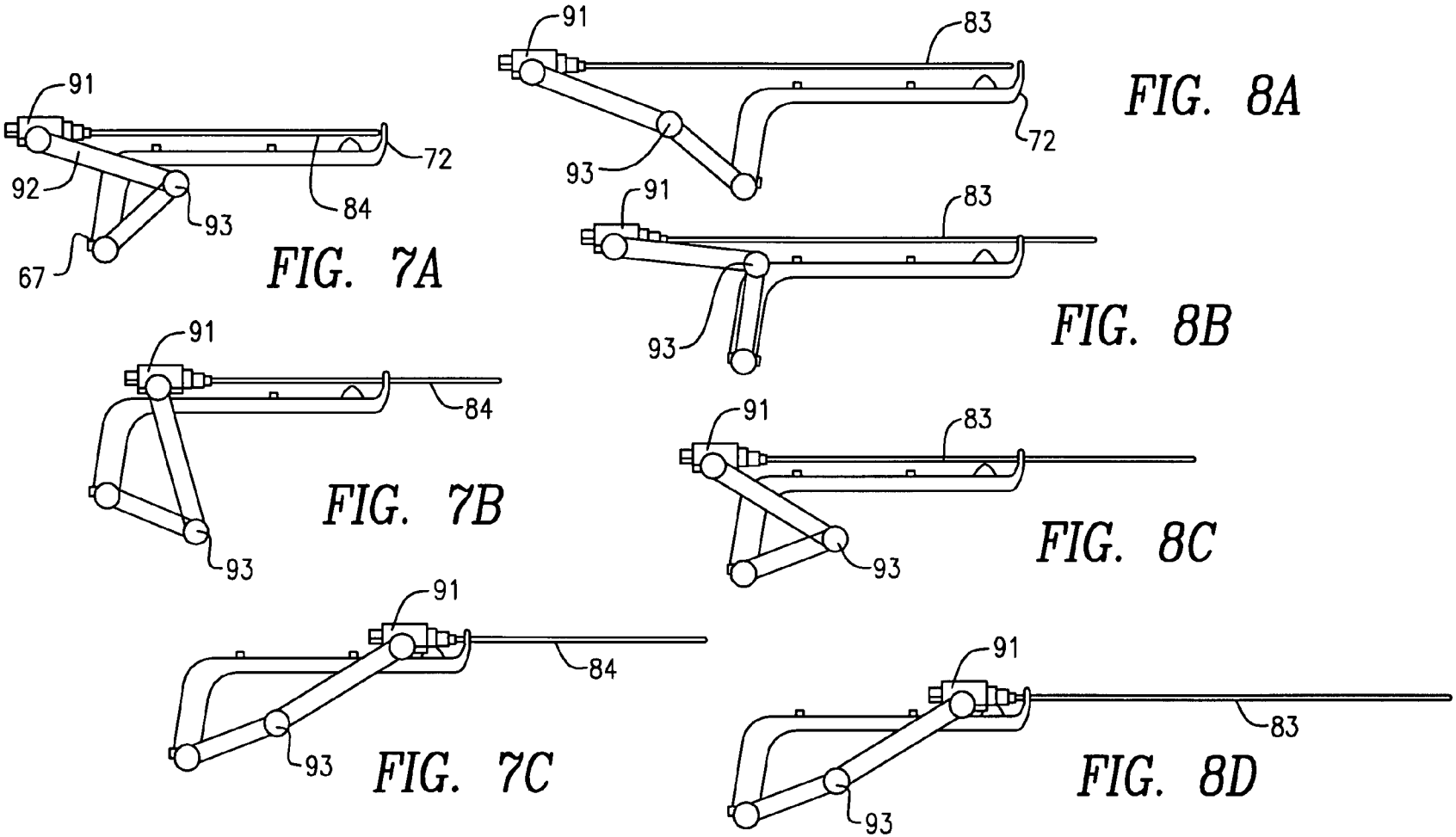
FIGS. 7A–C are sequential side views illustrating short drilling/bolting operation of the boom/drill means of the apparatus of FIG. 1.
FIGS. 8A–D are sequential side views illustrating long drilling operation of the boom/drill means of the apparatus of FIG. 1.
Figure 9:
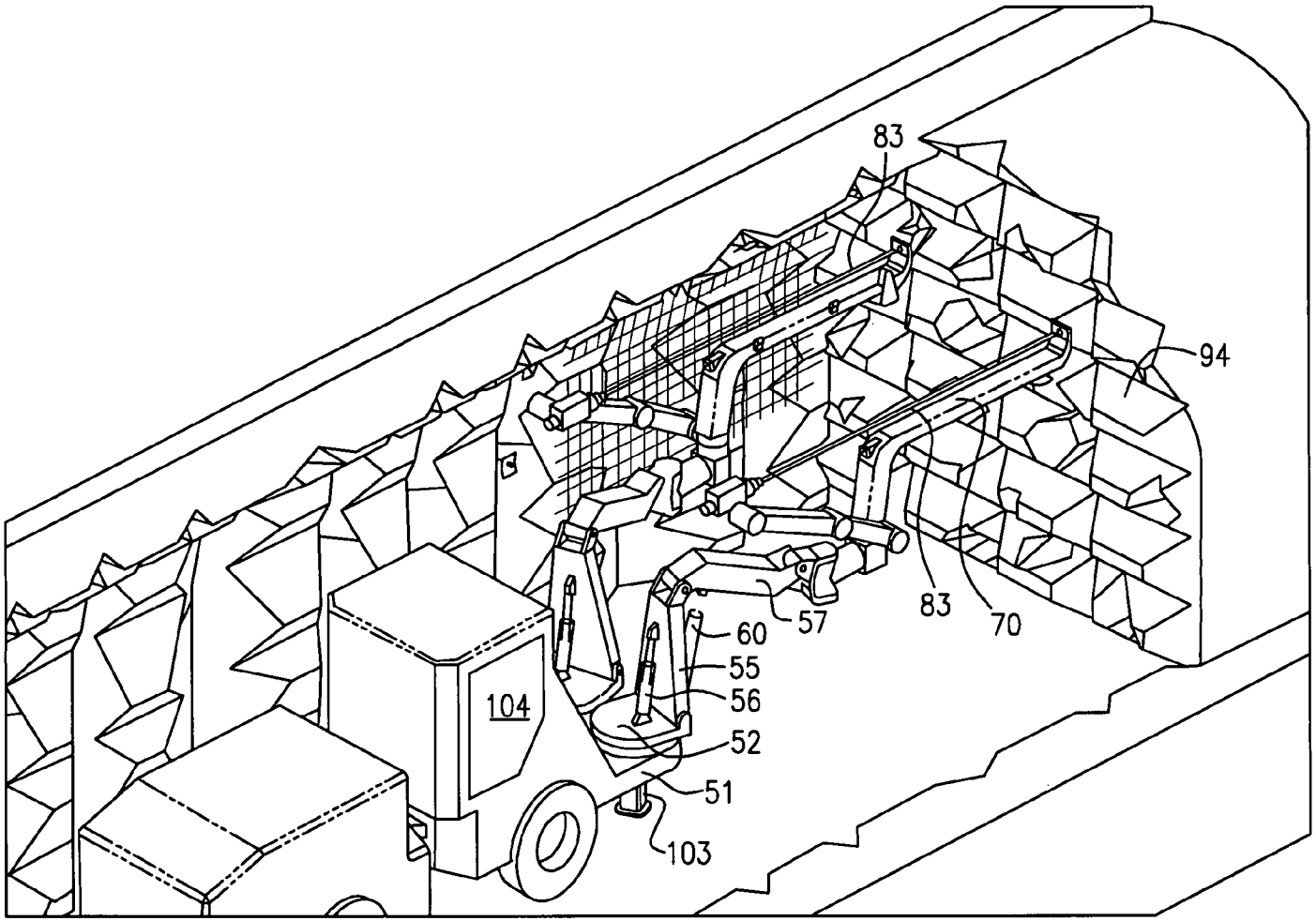
FIG. 9 is a perspective view of the apparatus of FIG. 1 deployed for blast hole drilling using the long drilling operation of FIG. 8.

In use the apparatus is located for drilling and bolting as illustrated in the sequence of FIGS. 3A to 3C, wherein (after engagement of the jacks 104) the primary arm 55, 56 locates the boom body 70 in concert with the tool mounting base 65 such that the drive wall engagement portion 72 is in contact with the drive wall at the desired position. The telescopic rear strut 80 is then extended to engage the drive wall opposite the drive wall engagement portion 72, thus essentially fixing the boom against movement.

It will of course be realized that while the above has been given by way of illustrative example of this invention, all such and other modifications and variations thereto as would be apparent to persons skilled in the art are deemed to fall within the broad scope and ambit of this invention as is herein set forth.

In other not shown embodiments the shape and configuration of the various components of the rock bolting apparatus may differ from that shown in the abovementioned embodiment. For instance, in one not shown embodiment the magazine housing 86 and/or magazine 76 may be fixed or integral with boom body 70.

Also in another not shown embodiment the belt 87 may be arranged radially in a drum housing rather than in serpentine fashion in a box housing.

Also in another not shown embodiment the aperture (drill guide) 73 may be done away with, and washer plate 77 is moved into place on channel 75 of boom body 70 and also acts as the drill guide instead of aperture 73.

The mesh dispenser 97, straightening rollers and sheering apparatus can, if desired, be carried by the vehicle 50 itself rather than towed as a consumables cart 96.

Figure 16A:
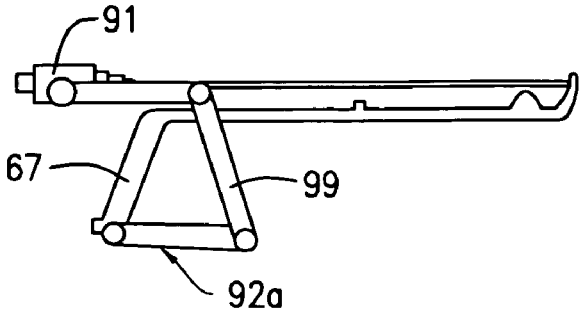
FIGS. 16A–D are sequential side views of drilling/bolting operation of a boom/drill means of an alternative embodiment of apparatus in accordance with the present invention.
Figure 16B:
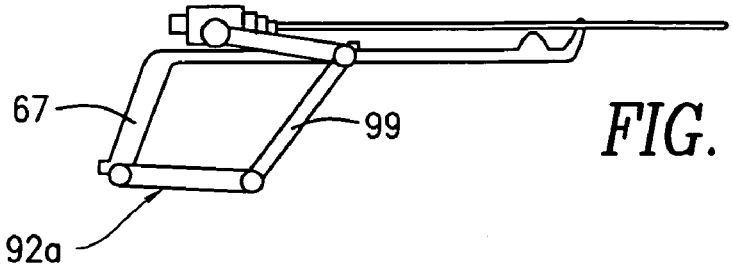
Figure 16C:
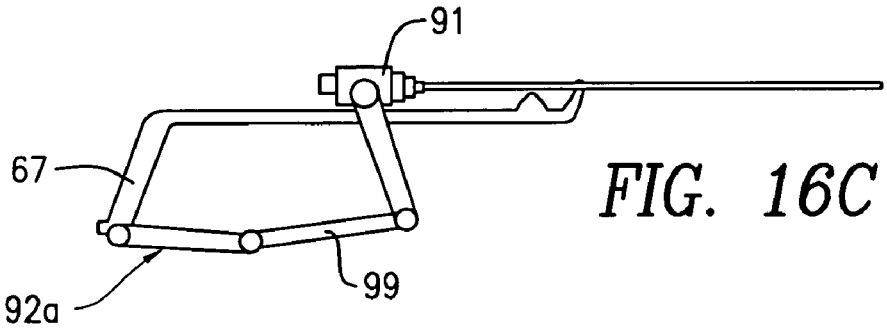
Figure 16D:
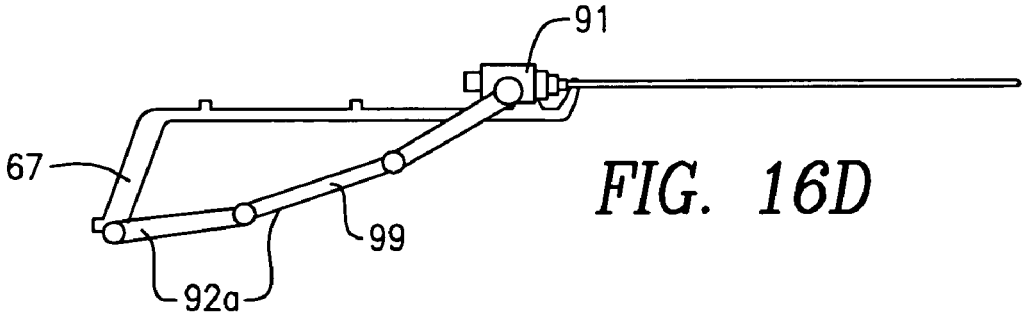

Whilst the abovementioned embodiment utilises a two-link tool arm 92 as shown in FIGS. 7A–C and 8A–D, it should be understood that in an alternative embodiment as shown in FIGS. 16A–C the two-link arm 92 may be replaced by a three-link tool arm 92*a*. It is similar to two-link tool arm 92, but has a third intermediate link 99 disposed between the pair of links that interconnect base portion 67 to drifter 91. It should also be understood that in other not shown embodiments, further intermediate links may be used such that the apparatus of the present invention may include a four, five or more link tool arm.

What is claimed:

1. An articulated boom arm for a rock boring machine, said arm comprising a first kinked member having a drill guide at one end and a base pivot at the other, and a pair of pivoted links, one of said links having a first end pivoted at said base pivot, the other of said links having a drill pivotally mounted at a first end thereof, the second ends of said first and second links being pivoted to each other whereby said drill is reciprocally linearly movable along said first member with a drill bit aligned with said drill guide and at one extremity of the reciprocal movement both said pair of links are substantially longitudinally aligned and extend towards said drill guide and at the other extremity of the reciprocal movement both said pair of links are substantially longitudinally aligned and extend away from said drill guide.

2. The articulated boom arm as claimed in claim 1, wherein said pair of links can be manipulated between said extremities to provide multiple modes of operation, to provide a longer stroke for a blast hole drilling and a shorter stroke for drilling and bolting.

3. The articulated boom arm as claimed in claim 1, wherein said arm is mounted on a seven axis manipulator assembly, said assembly comprising a turntable rotatable about a first substantially vertical axis, a first arm pivotally mounted to said turntable about a second, substantially horizontal axis, a second arm pivotally about a third, substantially horizontal axis, a yoke pivotally mounted to said second arm about a fourth, substantially horizontal axis and having a pair of arms defining a fifth axis about which a trunnion is pivoted, and a boom arm base support pivoted to said trunnion about a sixth axis substantially perpendicular to said fifth axis, said boom arm fist member being rotatably mounted to said base support about a seventh axis substantially perpendicular to said sixth axis.

4. The articulated boom arm as claimed in claim 1, wherein the second ends of said first and second links are pivoted to each other by at least one intermediate link.

* * * * *